US009377798B2

(12) United States Patent
Bhattad

(10) Patent No.: US 9,377,798 B2
(45) Date of Patent: Jun. 28, 2016

(54) DUAL MODE LOW DROPOUT VOLTAGE REGULATOR WITH A LOW DROPOUT REGULATION MODE AND A BYPASS MODE

(71) Applicant: Dialog Semiconductor GmbH, Kirchheim/Teck-Nabern (DE)

(72) Inventor: Ambreesh Bhattad, Swindon (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 323 days.

(21) Appl. No.: 14/031,080

(22) Filed: Sep. 19, 2013

(65) Prior Publication Data

US 2015/0077076 A1 Mar. 19, 2015

(30) Foreign Application Priority Data

Sep. 13, 2013 (EP) ..... 13392004

(51) Int. Cl.
*G05F 1/46* (2006.01)
*G05F 1/56* (2006.01)
*G05F 1/575* (2006.01)

(52) U.S. Cl.
CPC ..... *G05F 1/56* (2013.01)

(58) Field of Classification Search
USPC ..... 323/271–285, 311–315
See application file for complete search history.

(56) References Cited

U.S. PATENT DOCUMENTS 5,689,460 A 11/1997 Ooishi
6,373,754 B1 4/2002 Bae et al.
7,148,670 B2 * 12/2006 Inn ..... G05F 1/575 323/283
7,928,705 B2 * 4/2011 Hooijschuur ..... H02M 3/1582 323/272
7,956,494 B2 * 6/2011 Amerom ..... G06F 1/263 307/58
8,080,983 B2 * 12/2011 Lourens ..... G05F 1/575 323/275
8,310,218 B2 * 11/2012 Williams ..... H02M 3/07 323/265
8,432,140 B1 * 4/2013 Deutscher ..... H02M 3/158 323/222
8,587,268 B1 * 11/2013 Huard ..... H02M 3/158 323/268
8,629,649 B2 * 1/2014 Guo ..... H02J 7/0086 320/107
8,981,745 B2 * 3/2015 Price ..... G05F 1/56 323/274
9,052,729 B2 * 6/2015 Bhattad ..... G05F 1/56
9,058,761 B2 * 6/2015 Piasecki ..... G09G 3/04
9,104,218 B2 * 8/2015 Bhattad ..... G05F 1/46
2007/0152742 A1 7/2007 Rincon-Mora et al.
2008/0231242 A1 9/2008 Mann et al.
2009/0295344 A1 * 12/2009 Qu ..... G05F 1/56 323/265
2010/0060078 A1 * 3/2010 Shaw ..... G05F 1/56 307/31
2010/0194344 A1 * 8/2010 Greyling ..... H02M 3/157 320/128

(Continued)

FOREIGN PATENT DOCUMENTS

EP 13392004.1-1807 6/2014

*Primary Examiner* — Adolf Berhane
*Assistant Examiner* — Nusrat Quddus
(74) *Attorney, Agent, or Firm* — Saile Ackerman LLC; Stephen B. Ackerman; Billy Knowles

(57) ABSTRACT

A dual mode low dropout voltage regulator has a low dropout regulation mode and a bypass mode and provides a smooth transition between mode transitions taking place under load. When an accessory requires a larger voltage level, a bypass signal commands the dual mode low dropout voltage regulator to go into bypass mode and transfer voltage level of the unregulated input voltage source to the output of the dual mode low dropout voltage regulator. The dual mode low dropout voltage regulator provides a smooth transition to the bypass to prevent the output of the dual mode low dropout voltage regulator from decreasing or having a "brown out" until a pass transistor is forced to turn on fully to provide the voltage level of the unregulated input voltage source to fully bypass the low dropout regulating mode of operation.

16 Claims, 10 Drawing Sheets

(56) References Cited

U.S. PATENT DOCUMENTS

2010/0295476 A1 11/2010 Franco
2011/0248693 A1 10/2011 Karnik et al.
2012/0077551 A1 3/2012 Balteanu et al.
2012/0206125 A1* 8/2012 Apriletti ..... H02M 3/155 323/351
2013/0076326 A1* 3/2013 Lee ..... G05F 1/563 323/284
2013/0300386 A1* 11/2013 Priel ..... G05F 1/462 323/274
2014/0223205 A1* 8/2014 Muthukaruppan ..... G06F 1/32 713/320
2015/0035507 A1* 2/2015 Cowley ..... G05F 1/46 323/282
2015/0042295 A1* 2/2015 Cowley ..... H02M 3/158 323/269
2015/0061622 A1* 3/2015 Bhattad ..... G05F 1/56 323/280

* cited by examiner

DUAL MODE LOW DROPOUT VOLTAGE REGULATOR WITH A LOW DROPOUT REGULATION MODE AND A BYPASS MODE

TECHNICAL FIELD

This disclosure relates generally to voltage regulators, and particularly to low dropout (LDO) voltage regulators. More particularly, this disclosure relates to circuits and methods for controlling voltages and currents during transition between a low dropout regulation mode and a bypass mode of a dual mode low dropout voltage regulator.

BACKGROUND

Integrated circuit devices are being fabricated with semiconductor processes that operate at voltages of approximately 1.8 volts. However these integrated circuit devices may be part of electronic systems that operate with electronic accessory devices that require a higher voltage power source to function. In portable or mobile battery powered electronic devices a low dropout voltage regulator reduces the higher voltage of the battery to a safe operating voltage for the device requiring the lower voltage.

As is known in the art, a voltage regulator is a constant voltage source that adjusts its internal resistance to any occurring changes of load resistance to provide a constant voltage at the regulator output. FIG. 1 is a schematic diagram of a low dropout voltage regulator. The load resistance of the voltage regulator as shown is formed by the parallel combination of the equivalent series resistance $R_{ESR}$ of the load capacitor $C_L$ and the load resistor $R_L$.

In order to regulate the output voltage resulting from any changes is the load resistor $R_L$, the internal resistance of the voltage regulator must be adjusted to maintain the output voltage 55 at the desired level. To accomplish this, the output voltage is sensed by the voltage divider formed by the series resistors $R_1$ and $R_2$. As is known, the feedback voltage $V_{FB}$ is the product of the output voltage 55 and the ratio of the resistor $R_2$ and the sum of the series resistors $R_1$ and $R_2$. An error amplifier receives the feedback voltage $V_{FB}$ and compares it with a reference voltage $V_{REF}$ to generate an error voltage. The error voltage is amplified and conditioned by a pass gate driver circuit to create the output voltage of the error amplifier $A_{ERR}$.

The error amplifier $A_{ERR}$ has a differential amplifier formed of the differential pair of PMOS transistors P1 and P2. The NMOS transistors N1 and N2 for the load devices for the differential pair of PMOS transistors P1 and P2. A biasing current source $I_1$ provides the biasing current for the differential pair of transistors P1 and P2. The drains of the PMOS transistor P2 and the NMOS transistor N2 are connected to form the output terminal 13 of the differential pair of PMOS transistors P1 and P2 of the error amplifier $A_{ERR}$. The feedback voltage $V_{FB}$ that is developed at the common connection of the series resistors $R_1$ and $R_2$ is applied to the gate of the PMOS transistor P1. A reference voltage $V_{REF}$ is applied to the gate of the PMOS transistor P2. The difference in the feedback voltage $V_{FB}$ and the reference voltage $V_{REF}$ is developed at the output terminal 13 of the differential pair of transistors P4 and P5 of the error amplifier $A_{ERR}$ as the error voltage $V_{ERR}$. The drain of the PMOS transistor P1 is connected to the drain and gate of the NMOS transistor N1 and the gate of the NMOS transistor N2. The sources of the NMOS transistors N1 and N2 are connected to the ground reference voltage source.

The error amplifier $A_{ERR}$ provides an indication of the error between the feedback voltage $V_{FB}$ and the reference voltage $V_{REF}$ that is applied to gate of the PMOS pass transistor $P_{PASS}$. The drain-to-source voltage (Vds) and the drain-to-source current (Ids) determine the equivalent internal resistance of the low dropout voltage regulator. As is known, the drain-to-source voltage (Vds) and the drain-to-source current (Ids) are determined by the transconductance of the PMOS pass transistor $P_{PASS}$ and the gate-to-source voltage (Vgs) of the PMOS pass transistor $P_{PASS}$.

The dropout voltage of the low dropout regulator is normally defined the point at which the drain-to-source voltage (Vds) of the PMOS pass transistor $P_{PASS}$ is not changed when the gate-to-source voltage (Vgs) changes and the PMOS pass transistor $P_{PASS}$ is in saturation.

The size of the PMOS pass transistor $P_{PASS}$ is normally very large to provide the necessary current to the load resistance $R_L$. Further the load capacitance $C_L$ and the miller capacitance of the PMOS pass transistor $P_{PASS}$ create a zero the right hand plane that may cause instability in the error amplifier $A_{ERR}$ and cause oscillation in the output voltage. To alleviate the instabilities, the compensation capacitor $C_{COMP}$ is placed between the gate and the drain of the PMOS pass transistor $P_{PASS}$ to shift the zero sufficiently high in frequency to not cause the instabilities.

In some instances, an accessory device may require a higher voltage or current to operate than is available to the device requiring the lower voltage. When this occurs, a control system for the electronic device will enable a bypass circuit for the low dropout regulator thus connecting the higher voltage power supply or battery to the accessory device.

FIG. 2 is a schematic diagram of a low dropout voltage regulator including a bypass circuit of the prior art. The low dropout voltage regulator has two separate loops to control operation in a low dropout voltage regulation mode and a bypass mode. When the bypass mode control loop is deactivated, the low dropout regulation mode is in operation providing the required regulated low voltage. When the bypass mode control loop is activated, the low dropout regulation mode is not in operation and the bypass mode control loop is driving the PMOS pass transistor such that the output voltage is approaching the voltage level of the battery power source. An analog multiplexer is used to select the signal to drive the gate of pass device depending on mode of operation.

The LDO control circuit 10, as described above, has an error amplifier 12 that receives the feedback voltage $V_{FB}$ and compares it with a reference voltage $V_{REF}$ to generate an error voltage $V_{ERR}$. The feedback voltage $V_{FB}$ is applied to a gate of a first PMOS transistor P1 of a differential pair of transistors P1 and P2 and the reference voltage $V_{REF}$ is applied to the gate of a second PMOS transistor P2 of a differential pair of PMOS transistors P1 and P2. The NMOS transistors N1 and N2 are configured as a current source load for the differential pair of PMOS transistors P1 and P2. The current source I1 provides the constant current for determining the error voltage $V_{ERR}$.

The error voltage $V_{ERR}$ is applied to the pass gate driver circuit 14 to be amplified and conditioned to generate the gate control voltage 15. The pass gate driver circuit 14 has an NMOS transistor N3 that acts as the amplifier for the error voltage $V_{ERR}$. The current source I2 and the PMOS transistor P3 acts as the load circuit for the NMOS transistor N3 to generate the correct voltage level for the gate control voltage 15.

The gate control voltage 15 is an input to the analog multiplexer 20. The analog multiplexer 20 has two switches S1 and S2 that are alternately actuated and de-actuated for activating or bypassing the low dropout voltage operation. The gate control voltage 15 is applied to a first terminal of the switch S2. The second terminal of the switch S2 is connected to the gate 25 of the PMOS pass transistor $P_{PASS}$. The source of the PMOS pass transistor $P_{PASS}$ is connected to a terminal of the battery power source $V_{BAT}$ and the drain of the PMOS pass transistor $P_{PASS}$ is connected to the output terminal 55 of the low dropout voltage regulator to provide the output voltage $V_{OUT}$ and output current 60 to the load 65 of the external electronic circuits connected to the output terminal of the low dropout voltage regulator. The output terminal of the low dropout voltage regulator is further connected to the voltage divider formed by the two series connected resistors $R_1$ and $R_2$. A first terminal of the resistor $R_1$ is connected to the drain of the PMOS pass transistor $P_{PASS}$. A second terminal of the resistor $R_1$ is commonly connected to a first terminal of the resistor $R_2$ to provide the feedback voltage $V_{FB}$ as described above. The second terminal of the resistor $R_2$ is connected to the ground reference voltage source.

The enable signal 30 and the bypass signal 35 are applied from an external system controller (not shown) to the bypass control circuit 40. The bypass control circuit 40 generates a bypass gate control signal 50 that is transferred to a first terminal of the switch S1 of the analog multiplexer 20. The bypass signal 35 is connected to the control terminal of the switch S1 and the input of the inverter 22 of the analog multiplexer 20. The output of the inverter 22 is connected to the control terminal of the switch S2 to receive the inverse of the bypass control signal 35. When the enable signal 30 is activated and the bypass signal 30 is deactivated, the switch S1 is opened and the switch S2 is closed such that the gate control voltage 15 is transferred to the gate terminal 25 of the PMOS pass transistor $P_{PASS}$. When the enable signal 30 and the bypass signal 30 are activated, the switch S1 is closed and the switch S2 is opened such that the bypass gate control signal 50 is transferred to the gate terminal 25 of the PMOS pass transistor $P_{PASS}$. The LDO enable signal 45 is deactivated and the LDO control circuit 10 is disabled. When the LDO control circuit 10 is disabled the gate control voltage 15 is pulled to approximately the voltage level of the power supply voltage source VDD. The low dropout voltage regulator is operating in its bypass mode.

When the enable signal 30 is deactivated, the LDO control circuit 10 and the bypass control circuit 40 are both disabled. The low dropout voltage regulator is not operating.

FIG. 3 is a set of plots of signals at points within the low dropout voltage regulator including a bypass circuit of the prior art. At the time t1 the enable signal 30 is activated and the bypass control circuit 40 generates the LDO enable signal 45. The bypass signal 35 is deactivated. The LDO gate control signal 15 is transferred through the analog multiplexer 20 as the gate signal 25 to the gate of the PMOS pass transistor $P_{PASS}$ such that the PMOS pass transistor $P_{PASS}$ begins to conduct. At the time t2, the load current 60 is set to the current level as demanded by the load 65, when the output voltage level VOUT at the output terminal 55 has risen to the voltage level regulated by the low dropout voltage regulator.

At the time t3, the load in the form of another accessory requests additional power from the battery power source VBAT. A system controller (not shown) activates the bypass signal 35 and the bypass controller 25 deactivates the LDO enable signal 45. The LDO gate control signal 15 is deactivated and the gate signal is brought to the voltage level of the power supply voltage source VDD. The output voltage level 55 begins to decrease as the current required by the load 65 is drawn from the decoupling capacitors (not shown) attached with the load 65 to the output terminal of the low dropout voltage regulator. In the time between t3 and t4, the bypass control circuitry is biased with its internal nodes settling to desired potentials.

At the time t4, the bypass controller 20 activates the bypass gate control signal 50 and thus sets the gate signal 25 to turn on the PMOS pass transistor $P_{PASS}$ to a saturated condition. The output voltage VOUT at the output terminal 55 rises to a voltage level approaching the voltage level of the battery power source VBAT at the time t5.

In low dropout regulation mode, the analog multiplexer 20 selects the output of the low dropout regulator control circuit 10 to drive the PMOS pass transistor $P_{PASS}$ to provide the regulated low voltage to the output terminal 55. In bypass mode, the multiplexer 20 selects the output of bypass control circuit 25 to drive the PMOS pass transistor $P_{PASS}$ to provide the voltage level of the battery power source to the output terminal 55.

When bypass mode is enabled at the time t3, the analog multiplexer 20 immediately selects bypass gate control signal 50 to drive the gate of PMOS pass transistor $P_{PASS}$, which is still at the voltage level of the power supply voltage source VDD. There is a delay time in biasing the nodes of the bypass control circuit 25 and pull the signal bypass gate control signal 50 to the voltage level of the ground reference voltage, during this time, if the output terminal 55 of the low dropout voltage regulator has a load 65 connected and all the charge will be provided by the external capacitors (not shown) and the output voltage will decrease as shown between the times t3 and t5.

At the time t6, the bypass signal 35 is deactivated, which causes the LDO enable signal to be activated by the bypass control circuit 20. The bypass gate control signal 50 is deactivated and the LDO gate control signal 15 is activated and thus the gate signal 25 begins to adjust the gate voltage level to adjust the voltage across the PMOS pass transistor $P_{PASS}$ to regulate the output voltage level 55.

In bypass mode, the LDO gate control signal 15 is pulled high as the LDO control circuit 10 is disabled, as described above. It takes time for all the internal nodes of LDO control circuit 10 to reach their required potential for the required load current. The charge during this time is provided by output decoupling capacitor. Loss of charge form the capacitor results in decrease in output voltage. The decrease in output voltage is function of the load current and output capacitor. For large load currents and small output capacitor "brown-out condition" may arise, thus resetting the device and causing the load current 60 to go to a zero level. The device will try to recycle and if the output voltage level 55 has not stabilized it, as at the time t7, the device will continue to recycle.

SUMMARY

An object of this disclosure is to provide circuits and methods to facilitate a smooth transition between a low dropout regulation mode and a bypass mode of a dual mode low dropout voltage regulator.

Another object of this disclosure is to provide circuits and method that allow the transition between the low dropout regulation mode and the bypass mode of a of a dual mode low dropout voltage regulator to occur under load.

To accomplish at least one of these objects, a dual mode low dropout voltage regulator operates in a low dropout regulated voltage mode or a bypass mode. In the bypass mode, the dual mode low dropout voltage regulator applies an unregulated input voltage source voltage to an output terminal of the dual mode low dropout voltage regulator. The dual mode low dropout voltage regulator has a mode transition circuit. The mode transition circuit has a bypass delay circuit connected to receive a bypass signal from a system controller in communication with the dual mode low dropout voltage regulator. The bypass signal is delayed by a factor equivalent to delay time in biasing internal nodes of a bypass control circuit within the dual mode low dropout voltage regulator connected to receive the bypass signal. The delayed bypass signal is transferred to an analog multiplexer for controlling the application of the bypass gate control signal and a low dropout gate control signal to a gate of a pass transistor of the dual mode low dropout voltage regulator.

The dual mode low dropout voltage regulator has a low dropout voltage control circuit having an error amplifier that compares a feedback voltage developed from a regulated output voltage of the dual mode low dropout voltage regulator with a reference voltage to develop the error voltage. The low dropout voltage control circuit has a pass gate driver circuit that receives the error voltage level from the error amplifier and amplifies and conditions the error voltage level to drive the gate of the pass transistor.

The mode transition circuit has an switched error voltage clamp that fixes the error voltage such that the error voltage level is close to its operating point in a bypass mode to prevent an output voltage of the dual mode low dropout voltage regulator from decreasing at the initiation of the bypass mode. The mode transition circuit has a bypass clamp that fixes the output voltage of the low dropout voltage control circuit to be set to approximately the voltage level of the power supply voltage source when the delayed bypass signal becomes active. When the delayed bypass signal becomes active, the analog multiplexer transfers a bypass gate control signal to a gate of a pass transistor to turn on the pass transistor completely to transfer the voltage of the unregulated input voltage source to the output of the dual mode low dropout voltage regulator.

When the bypass signal is disabled, the error voltage clamp and the bypass clamp are deactivated. The analog multiplex selects the output voltage of the low dropout voltage control circuit to be applied to the gate of the pass transistor such that the output voltage of the dual mode low dropout voltage regulator resumes the regulated voltage level.

In other embodiments, a dual mode low dropout voltage regulator has a low dropout voltage control circuit providing an error amplifier that compares a feedback voltage developed from a regulated output voltage of the dual mode low dropout voltage regulator with a reference voltage to develop the error voltage. The dual mode low dropout voltage regulator has a bypass circuit that smoothly transitions from the low dropout regulation mode to the bypass mode. The bypass circuit has an switched error voltage clamp connected to the error amplifier that fixes the error voltage such that the error voltage level is close to its operating point in a bypass mode to prevent the an output voltage of the dual mode low dropout voltage regulator from decreasing at the initiation of the bypass mode.

The error amplifier is connected to a pass gate driver that conditions the error voltage for driving a gate of a pass transistor to set the output voltage level of the dual mode low dropout voltage regulator. The bypass circuit has a bypass control circuit connected to the pass gate driver to force the voltage level of the output of the low dropout voltage control circuit to turn on the pass transistor such that the voltage level of the output of the dual mode low dropout voltage regulator is approximately equal to the voltage level of the unregulated input voltage source.

In various embodiments, the switched error voltage clamp is formed of a clamp diode transistor in series with a switching device. The switching device having a first terminal connected to the output of the error amplifier and a second terminal connected to an anode of the clamp diode. The cathode of the clamp diode is connected to a ground reference voltage source. The clamp diode in various embodiments is a PN junction diode, a diode connected bipolar junction transistor, a diode connected PMOS or NMOS field effect transistor. A control terminal of the switching device is connected to receive the bypass signal such that the switching device is activated when the bypass signal is activated.

In various embodiments, the bypass control circuit has a current limiting resistor in parallel with a bypass switch. The bypass switch is closed when the low dropout voltage control circuit is providing the gate voltage to the pass transistor for providing the regulated output voltage. When the bypass signal is activated the bypass switch is opened and the switched error clamp causes the gate voltage to turn on the pass transistor such that the output voltage of the dual mode low dropout voltage regulator is approximately the voltage level of the unregulated input voltage source. The current limiting resistor constrains the current within the pass gate driver during the bypass mode.

In some embodiments, the bypass control circuit has a bypass control device having a drain terminal connected to the output of the pass gate driver. The bypass control device has a control gate connected to receive the bypass signal and a source connected to a ground reference voltage source. The bypass control device, when activated by the bypass signal forces the output voltage level of the pass gate driver to a voltage level to force the pass device to turn on and the voltage level of the output of the dual mode low dropout voltage regulator is approximately equal to the voltage level of the unregulated input voltage source.

DETAILED DESCRIPTION

Figure 1:
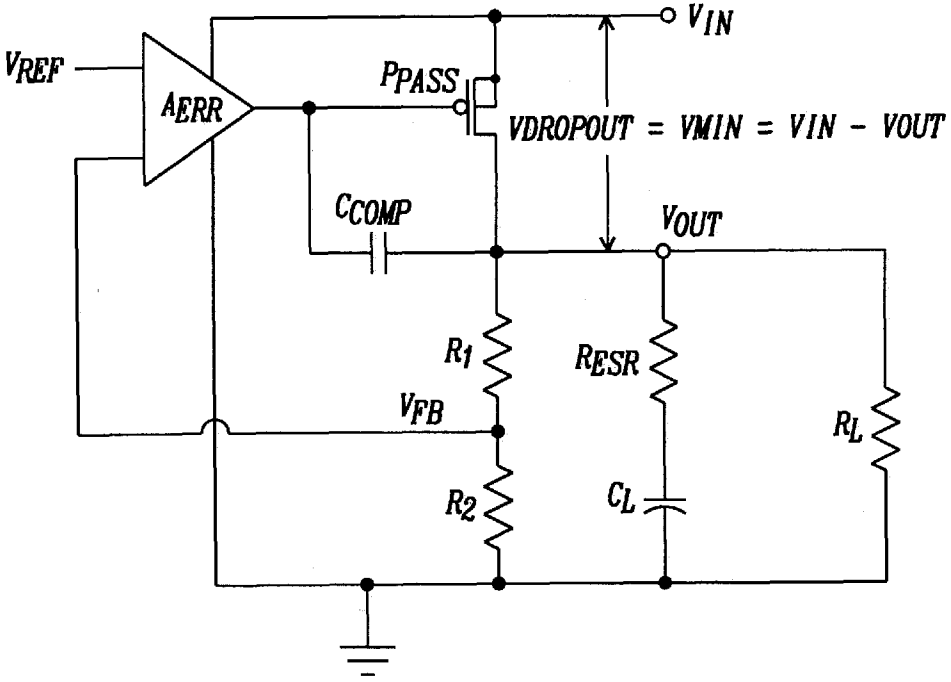
FIG. 1 is a schematic diagram of a low dropout voltage regulator.

A dual mode low dropout voltage regulator embodying the principles of this disclosure operates in a low dropout regulation mode and a bypass mode and provides circuits that insure a smooth transition between mode transitions taking place under any load. The dual mode low dropout voltage regulator embodying the principles of this disclosure is enabled by the application of an external enabling signal. As described above in FIG. 1 for a dual mode low dropout voltage regulator of the prior art with a bypass mode, an error amplifier compares a feedback voltage that is a proportional value of the output voltage level of the dual mode low dropout voltage regulator. The output of the error amplifier is conditioned to drive a gate of a pass transistor of the dual mode low dropout voltage regulator to regulate the output voltage level of the dual mode low dropout voltage regulator. The voltage of the output of the error amplifier is adjusted until the voltage level at the output of the dual mode low dropout voltage regulator is at its regulated voltage level.

A system controller receives a request from an accessory attached to the system for a power level (voltage and/or current level) that is larger than the regulated voltage level of the dual mode low dropout voltage regulator. The system controller activates the bypass signal commanding the dual mode low dropout voltage regulator to go into the bypass mode and transfer voltage level of the unregulated input voltage source to the output of the dual mode low dropout voltage regulator. The dual mode low dropout voltage regulator is functioning in its normal operating mode to continue to provide a smooth transition to the bypass to prevent the output of the dual mode low dropout voltage regulator from decreasing or having a "brown out". The pass transistor is then forced to turn on fully to provide the voltage level of the unregulated input voltage source to fully bypass the low dropout regulating mode of operation. The dual mode low dropout voltage regulator remains in the bypass mode until the accessory is disabled. The low dropout regulation mode may be re-established or the enable signal for the dual mode low dropout voltage regulator may be deactivated and the power turned off for the device into which the dual mode low dropout voltage regulator is operating.

Figure 2:
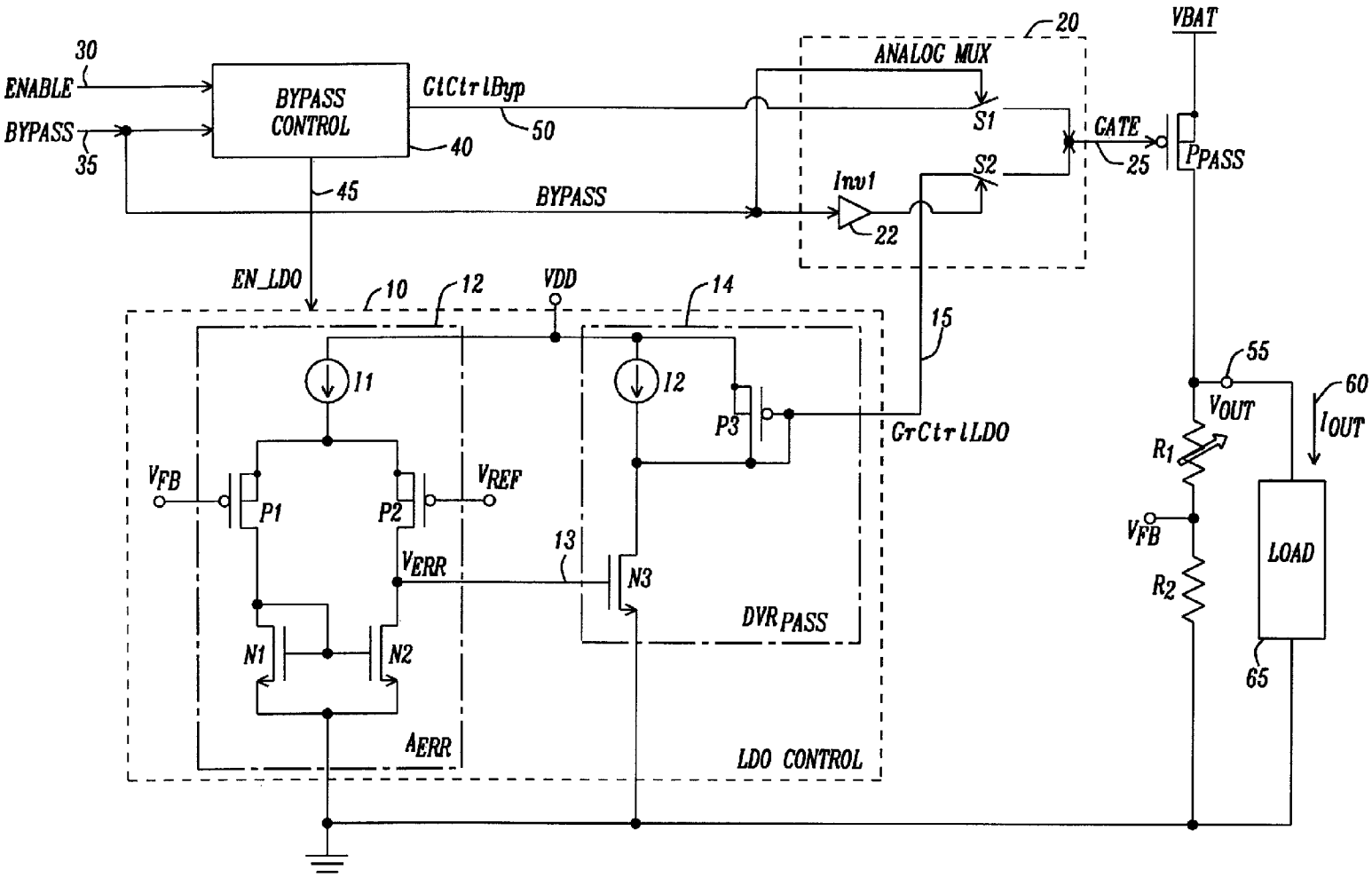
FIG. 2 Prior Art
FIG. 2 is a schematic diagram of a dual mode low dropout voltage regulator including a bypass circuit of the prior art.
Figure 3:
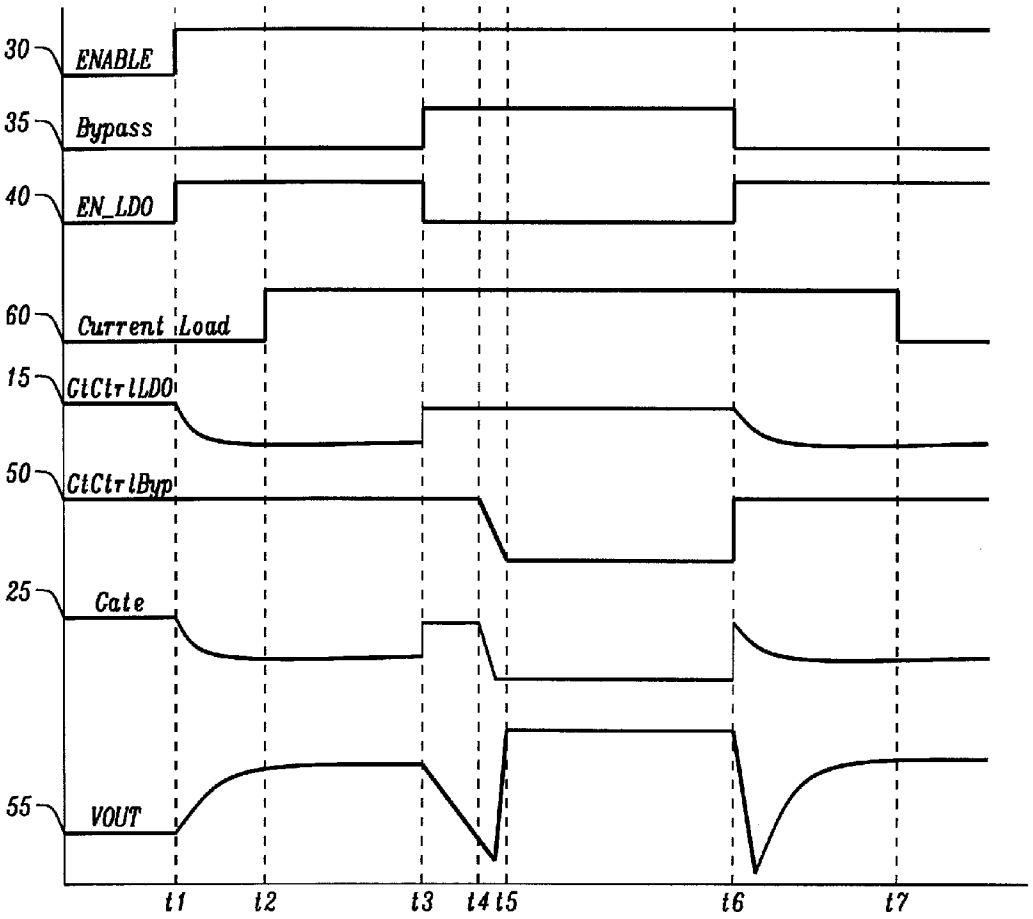
FIG. 3 Prior Art
FIG. 3 is a set of plots of signals at points within the low dropout voltage regulator including a bypass circuit of the prior art.
Figure 4:
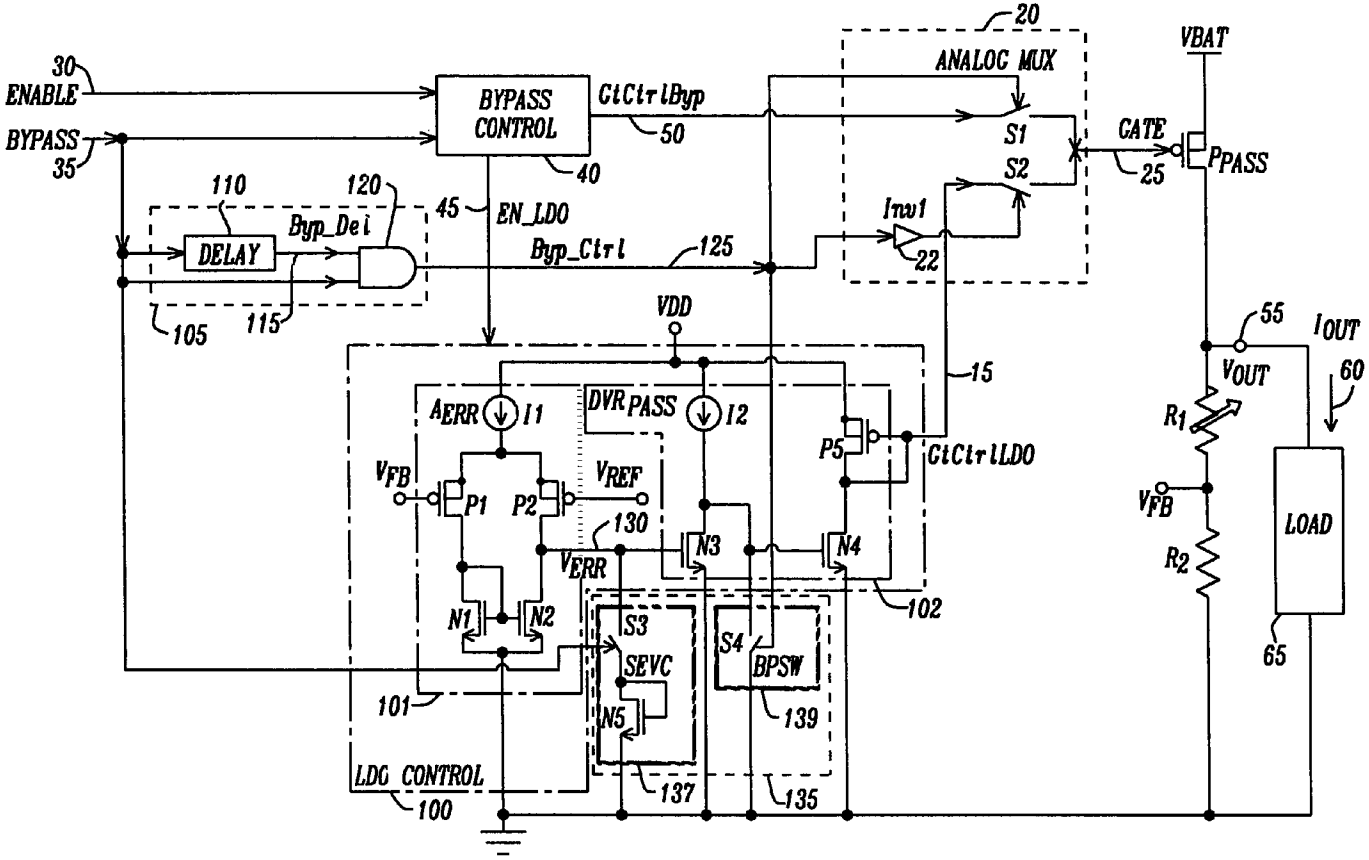
FIG. 4 is a schematic diagram of a dual mode low dropout voltage regulator of various embodiments exemplifying the principles of the present disclosure.

FIG. 4 is a schematic diagram of a dual mode low dropout voltage regulator including a bypass circuit of various embodiments exemplifying the principles of the present disclosure. The dual mode low dropout voltage regulator receives the enable signal 30 and the bypass signal 35 from the external system control to provide operational supervision of the dual mode low dropout voltage regulator as described in FIG. 2. The enable signal 30 is applied to the bypass control circuit 40 The bypass control circuit 40 and the analog multiplexer 20 are structured and function as described in FIG. 2. The bypass control circuit 40 generates the bypass gate control signal 50 that is applied to the first terminal of the switch S1 of the analog multiplexer 20. When the bypass signal 35 is activated, the switch S1 closes to transfer the bypass gate control signal 50 to the second terminal of the switch S1 and thus to the gate 25 of the PMOS pass transistor $P_{PASS}$ to turn on the PMOS pass transistor $P_{PASS}$ to transfer the voltage level of the unregulated battery voltage source to the output terminal 55 of the dual mode low dropout voltage regulator.

The bypass signal 35 is applied to a bypass delay circuit 105. The bypass delay circuit 105 has delay element structures 110 that delay the bypass signal 35 by a factor approximately equivalent to the delay time in biasing internal nodes of the bypass control circuit 40 to generate the delayed bypass control signal 115. The bypass signal 35 and the delayed bypass signal 115 are applied to the AND circuit 120 to generate the bypass control signal 125. The bypass control signal 125 is applied to the inverter 22 and the control terminal of the switch S1 of the analog multiplexer 20. The output of the inverter 22 is the inverse of the bypass control signal 125 and is applied to the control terminal of the switch S2. The bypass control signal 125 is activated at approximately the same time that the bypass gate control signal 50 such that when the low dropout control circuit 100 is deactivated with opening of the switch S2 and the closing of the switch S1 transfers the bypass gate control signal 50 to the gate 25 of the PMOS pass transistor $P_{PASS}$ to cause the voltage level $V_{OUT}$ at the output terminal 55 to be set to approximately the voltage level of the unregulated battery voltage source $V_{BAT}$.

The bypass signal 35 is applied to the low dropout control circuit 100. The bypass control circuit 40 generates a low dropout signal 45 that is transferred to the low dropout control circuit 100. The low dropout control circuit 100 has an error amplifier 101 that is structured and functions as the error amplifier 12 of FIG. 2. The low dropout control circuit 100 also has a pass gate driver circuit 102 that is structured and functions identically to the pass gate driver circuit 14 of FIG. 2.

To provide the smooth transition between the normal low dropout voltage regulating mode and the bypass mode, the dual mode low dropout voltage regulator has a mode transition circuit 135. The mode transition circuit has a switched error voltage clamp 137. The switched error voltage clamp 137 has a switch S3 that has a first terminal connected to the output 130 of the error amplifier 101 and the gate of the NMOS transistor N3 of the pass gate driver circuit 102. A second terminal of the switch S3 is connected to an anode of clamp diode. The clamp diode is formed of a gate and drain of a diode connected transistor N5. A cathode of the clamp diode is formed of the source of the diode connected transistor N5 is connected to the ground reference voltage source.

The mode transition circuit 135 has a bypass switch circuit 139. The bypass switch circuit 139 has switch S4 that has a first terminal connected to the drain of the transistor N3 and the gate of the transistor N4. A control terminal of the switch S4 is connected to receive the bypass control signal 125. When the bypass signal 35 is activated, the switch S3 is closed and the error voltage level $V_{ERR}$ is fixed at approximately the operating level in the bypass mode. The NMOS transistor N3 begins to turn off and the NMOS transistor N4 begins to turn on causing the low dropout gate control voltage 15 to decrease and causing the PMOS pass transistor $P_{PASS}$ to increase in voltage to the voltage level of the unregulated input Battery supply source VBAT. When the bypass control signal 125 deactivates the switch S2 and activates the switch S1 and the switch S4 of the bypass switch circuit 139, the switch S4 causes the gate of the NMOS transistor N4 to be clamped to the voltage level of the ground reference voltage source and thus the low dropout gate control voltage 15 is forced to the voltage level of the power supply voltage source VDD. The bypass gate control voltage 50 is now applied to the gate of the PMOS pass transistor $P_{PASS}$ to cause the drain of the PMOS pass transistor $P_{PASS}$ and thus the voltage level $V_{OUT}$ at the output terminal 55 of the dual mode low dropout voltage regulator to become approximately the voltage level of the unregulated input battery voltage source.

Figure 5:
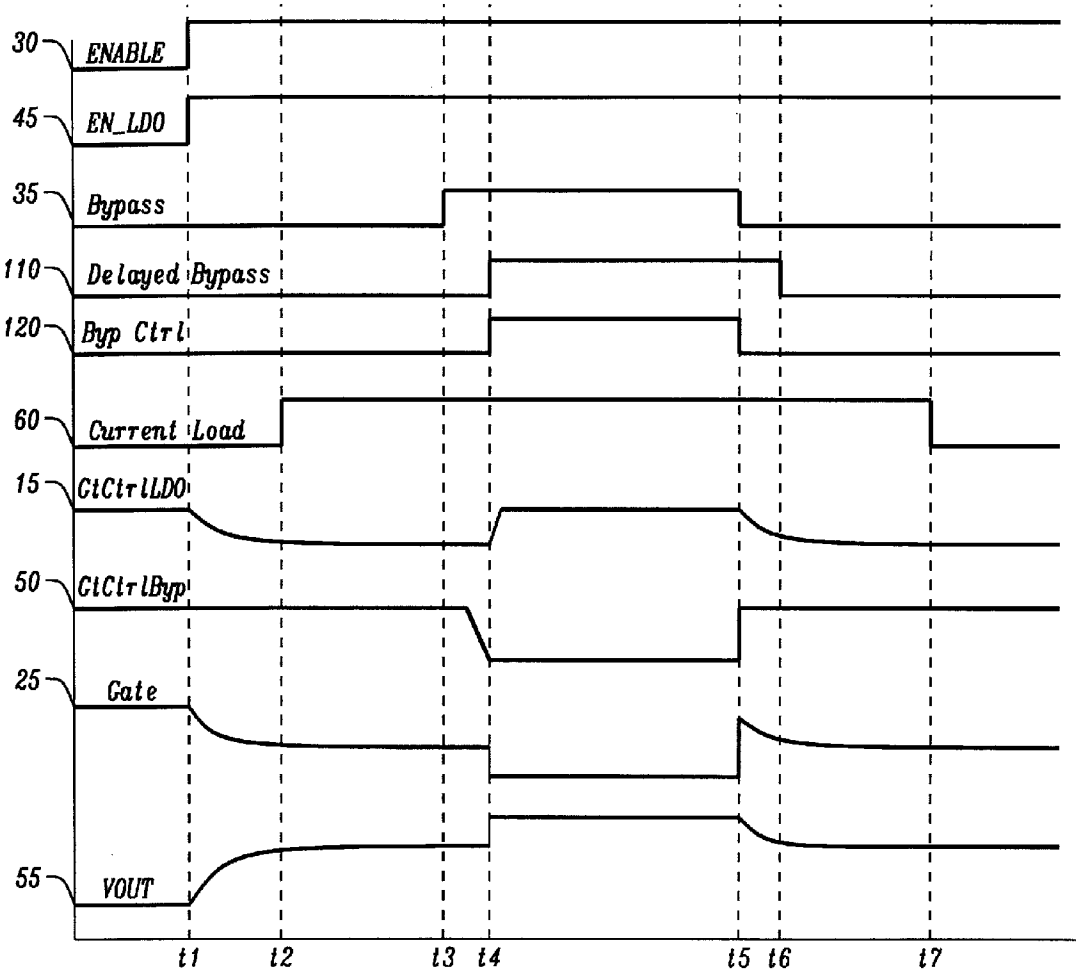
FIG. 5 is a set of plots of signals at points within the dual mode low dropout voltage regulator of the embodiments of FIG. 4 exemplifying the principles of the present disclosure.

FIG. 5 is a set of plots of signals at points within the dual mode low dropout voltage regulator of the embodiments of FIG. 4 exemplifying the principles of the present disclosure. Referring now to FIGS. 4 and 5, at the time t1 the enable signal 30 is activated. The bypass control circuit 40 generates the low dropout enable signal 45. The bypass signal and thus the delayed bypass signal 110 and the bypass control signal 125 are not activated. The load current 60 has not started to develop since the accessory (not shown) attached to the dual mode low dropout voltage regulator is not demanding current from the dual mode low dropout voltage regulator. Once the accessory starts to demand power from the dual mode low dropout voltage regulator, the output voltage $V_{OUT}$ at the output terminal 55 of the dual mode low dropout voltage regulator is beginning to develop as the internal nodes of the low dropout control circuit 100 to adjust the error voltage $V_{ERR}$ to set the feedback voltage to closely match the reference voltage $V_{REF}$. The low dropout gate control voltage 15 is adjusted to set the voltage level of the gate 25 to turn on the PMOS pass transistor $P_{PASS}$ to start applying the regulated output voltage level $V_{OUT}$ to the output terminal 60 of the dual mode low dropout voltage regulator and thus to the load circuit 65 at the time t2. The load current 60 now assumes its operating level.

Between the times t2 and t3, an accessory is added to the system requiring a higher voltage or an accessory within the system has activated a feature that requires the higher power (voltage and/or current). At the time t3, the system controller activates the bypass signal 35. The bypass delay circuit 105 delays the bypass signal by a delay factor approximately equal to the delay caused as the nodes of the bypass control circuit 40 are charged. At the end of the delay from the delay element 110, the delayed bypass signal 115 and the bypass control signal 125 are activated at the time t4.

Between the times t3 and t4, the switched error voltage clamp 103 is activated to clamp the error voltage $V_{ERR}$ to near the operating voltage of the error amplifier 101. At the time t4, the gate bypass control voltage 50 is set by the bypass control circuit 40 to a voltage level that causes to cause the drain of the PMOS pass transistor $P_{PASS}$ and thus the voltage level $V_{OUT}$ at the output terminal 55 of the dual mode low dropout voltage regulator to become approximately the voltage level of the unregulated input battery voltage source VBAT. The bypass control signal 125 activates the switch S4 thus causing the gate of the NMOS transistor N4 to be clamped to the voltage level of the ground reference voltage source and thus the low dropout gate control voltage 15 is forced to the voltage level of the power supply voltage source VDD.

When the accessory that is requiring the excess voltage is disabled at the time t5, the bypass signal 35 is disabled. The bypass control signal 120 is deactivated and the switch S1 is opened and the switch S2 is closed. The bypass gate control signal 50 is brought to the voltage level of the power supply voltage source and the low dropout gate control signal 15 begins to control the voltage level applied to the gate of the PMOS pass transistor $P_{PASS}$ and the output voltage $V_{OUT}$ at the output terminal 55 of the dual mode low dropout voltage regulator. The switches S3 and S4 are opened and the error amplifier 101 begins to regulate the output voltage $V_{OUT}$ at the output terminal 55 of the dual mode low dropout voltage regulator to the voltage level controlled by the reference voltage $V_{REF}$. At the time t6, the delayed bypass signal 110 is deactivated. This has no effect since the delayed bypass signal 110 is logically AND'ed with the bypass signal 35 and the bypass signal 35 dominates the logic in this state.

At the time t7, the accessory attached to the dual mode low dropout voltage regulator is disabled and the load current 60 goes to a zero level. The dual mode low dropout voltage regulator continues to maintain the output voltage level VOUT at the output terminal 55 at the voltage level controlled by the reference voltage $V_{REF}$.

Figure 6:
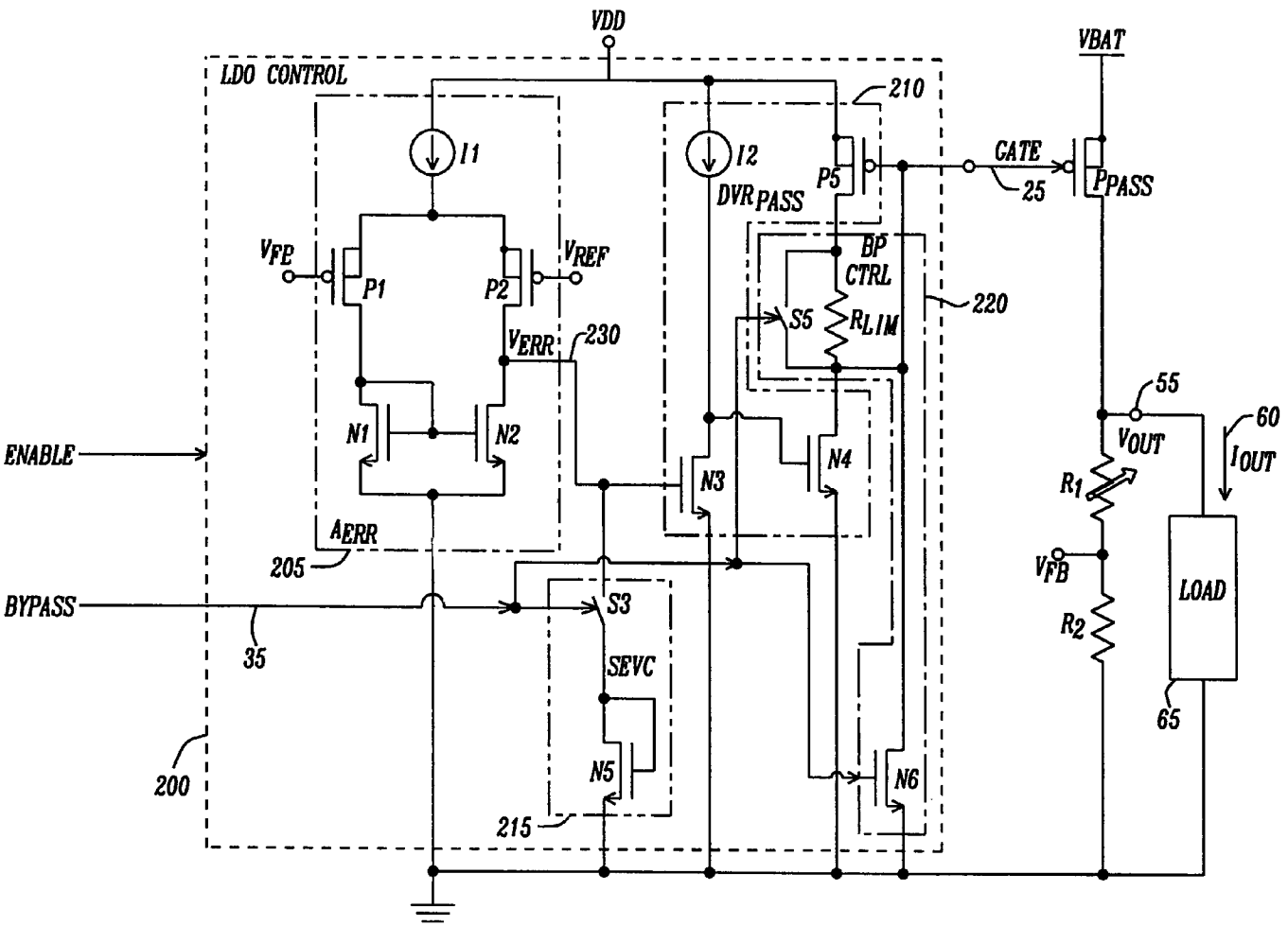
FIG. 6 is a schematic diagram of a dual mode low dropout voltage regulator of some embodiments exemplifying the principles of the present disclosure.

FIG. 6 is a schematic diagram of a dual mode low dropout voltage regulator of some embodiments exemplifying the principles of the present disclosure. The dual mode low dropout voltage regulator provides a seamless transition between low dropout operation mode and the bypass mode under load. In various embodiments, the bypass control circuit 220 for transferring between the bypass mode and the low dropout operating mode is embedded in the low dropout control circuit 200. The analog multiplexer 20 and the bypass delay circuit 105 of FIG. 4 are no longer necessary and are removed. The dual mode low dropout voltage regulator receives the enable signal 30 and the bypass signal 35 from the external system control to provide operational supervision of the dual mode low dropout voltage regulator as described in FIG. 2.

The bypass signal 35 is applied to the low dropout control circuit 200. The low dropout control circuit 200 has an error amplifier 205 that is structured and functions as the error amplifier 12 of FIG. 2. The low dropout control circuit 200 also has a pass gate driver circuit 210 that is structured and functions identically to the pass gate driver circuit 14 of FIG. 2. As described in FIG. 2, when the enable signal 30 is deactivated the dual mode low dropout voltage regulator is disabled with the low dropout control circuit 200 and the bypass control circuit 220 each not operating. When the enable signal 30 is activated and the bypass signal 35 is deactivated, the switch S3 is opened and the switch S5 is closed and the gate control voltage is transferred to the gate terminal 25 of the PMOS pass transistor $P_{PASS}$ for providing the regulated output voltage Vout at the output terminal 55. When the enable signal 30 and the bypass signal 30 are activated, the low dropout control circuit 200 clamps the gate terminal 25 of the PMOS pass transistor $P_{PASS}$ to the ground reference voltage level to turn on the PMOS pass transistor $P_{PASS}$ to cause the output voltage Vout at the output terminal 55 have a voltage level that is approximately the unregulated input battery supply source VBAT.

To provide the smooth transition between the normal low dropout voltage regulating mode and the bypass mode, the dual mode low dropout voltage regulator has a mode transition circuit. The mode transition circuit has a switched error voltage clamp 215 and a bypass control circuit 220. The switched error voltage clamp has a switch S3 that has a first terminal connected to the output 230 of the error amplifier 205 and the gate of the NMOS transistor N3 of the pass gate driver circuit 210. A second terminal of the switch S3 is connected to an anode of a clamp diode. The clamp diode is formed of a gate and drain of a diode connected transistor N5. A cathode of the clamp diode formed of the source of the diode connected transistor N5 is connected to the ground reference voltage source.

The bypass control circuit 220 is placed between the drain of the NMOS transistor N4 and the drain of the PMOS transistor P5. The bypass control circuit 220 has a switch S5 placed in parallel with a current limiting resistor $R_{LIM}$. A first terminal of the switch S5 and the first terminal of the current limiting resistor $R_{LIM}$ are connected to the drain of the PMOS transistor P5. A second terminal of the switch S5 and a second terminal of the current limiting resistor $R_{LIM}$ are connected to the drain of the NMOS transistor N4, the gate of the PMOS transistor P5, and a drain of a NMOS transistor N6. The source of the NMOS transistor N6 is connected to the ground reference voltage source. The control terminal of the switch S5 and the gate of the NMOS transistor N6 are connected to receive the bypass signal 35. The switch S5 is closed with the bypass signal 35 is deactivated and is opened when the bypass signal 35 is activated.

When the bypass signal 35 is activated, the switch S3 is closed, the switch S5 is opened, and the transistor N6 is turned on. The error voltage level $V_{ERR}$ is fixed at approximately the operating level in the bypass mode. The NMOS transistor N3 begins to turn off and the NMOS transistor N4 begins to turn on, but at this time the turning on of the NMOS transistor N6 causes the gate 25 of the PMOS pass transistor $P_{PASS}$ to be clamped to the voltage level of the ground reference voltage source and causing the PMOS pass transistor $P_{PASS}$ to increase in voltage to the voltage level of the unregulated input battery supply source VBAT. The PMOS transistor P5 also begins to conduct a large amount of current that is limited by the current limiting resistor $R_{LIM}$.

Figure 7:
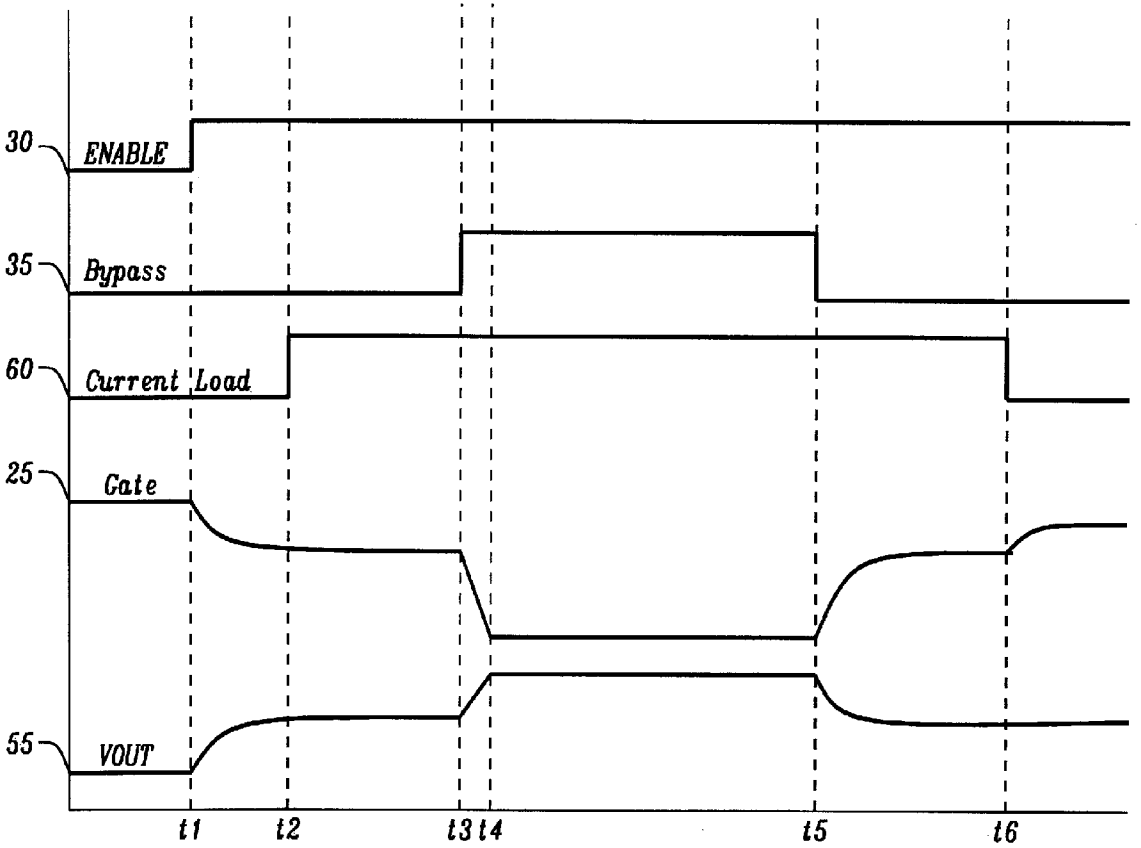
FIG. 7 is a set of plots of signals at points within the dual mode low dropout voltage regulator of the embodiments of FIG. 6 exemplifying the principles of the present disclosure.

FIG. 7 is a set of plots of signals at points within the dual mode low dropout voltage regulator of the embodiments of FIG. 6 exemplifying the principles of the present disclosure. Referring now to FIGS. 6 and 7, at the time t1 the enable signal 30 and the low dropout enable signal 45 are activated. The load current 60 has not started to develop since the output voltage $V_{OUT}$ at the output terminal 60 of the dual mode low dropout voltage regulator is beginning to develop as the internal nodes of the adjust the error voltage $V_{ERR}$ to set the feedback voltage to closely match the reference voltage $V_{REF}$. The low dropout gate control voltage 15 is adjusted to set the voltage level of the gate 25 to turn on the PMOS pass transistor $P_{PASS}$ to start applying the regulated output voltage level $V_{OUT}$ to the output terminal 60 of the dual mode low dropout voltage regulator and thus to the load circuit 65 at the time t2. The load current 60 now assumes its operating level.

Between the times t2 and t3, an accessory is added to the system requiring a higher voltage or an accessory within the system has activated a feature that requires the higher voltage. At the time t3, the system controller activates the bypass signal 35. The switch S3 is closed, the switch S5 is opened, and the NMOS transistor N6 is turned on. Between the times t3 and t4, the switched error voltage clamp 215 clamps the error voltage $V_{ERR}$ to near the operating voltage of the error amplifier 205. The turning on of the NMOS transistor N6 causes the gate 25 of the PMOS pass transistor $P_{PASS}$ to be clamped to the voltage level of the ground reference voltage source and causing the PMOS pass transistor $P_{PASS}$ to increase in voltage to the voltage level of the unregulated input battery supply source VBAT. The PMOS transistor P5 also begins to conduct a large amount of current that is limited by the current limiting resistor $R_{LIM}$.

When the accessory that is requiring the excess voltage is disabled at the time t5, the bypass signal 35 is disabled. When the bypass signal 35 deactivates the switch S3 and activates the switch S5 and turns off the NMOS transistor N6, the error voltage $V_{ERR}$ from the output terminal 230 of the error amplifier 205 begins to control the gate of the NMOS transistor N3. The voltage at the gate of the PMOS pass transistor $P_{PASS}$ begins to set such that the output voltage $V_{OUT}$ at the output terminal 55 is beginning to be regulated.

At the time t6, the accessory attached to the dual mode low dropout voltage regulator is disabled and the load current 60 goes to a zero level. The dual mode low dropout voltage regulator continues to maintain the output voltage level VOUT at the output terminal 55 at the voltage level controlled by the reference voltage $V_{REF}$.

Figure 8:
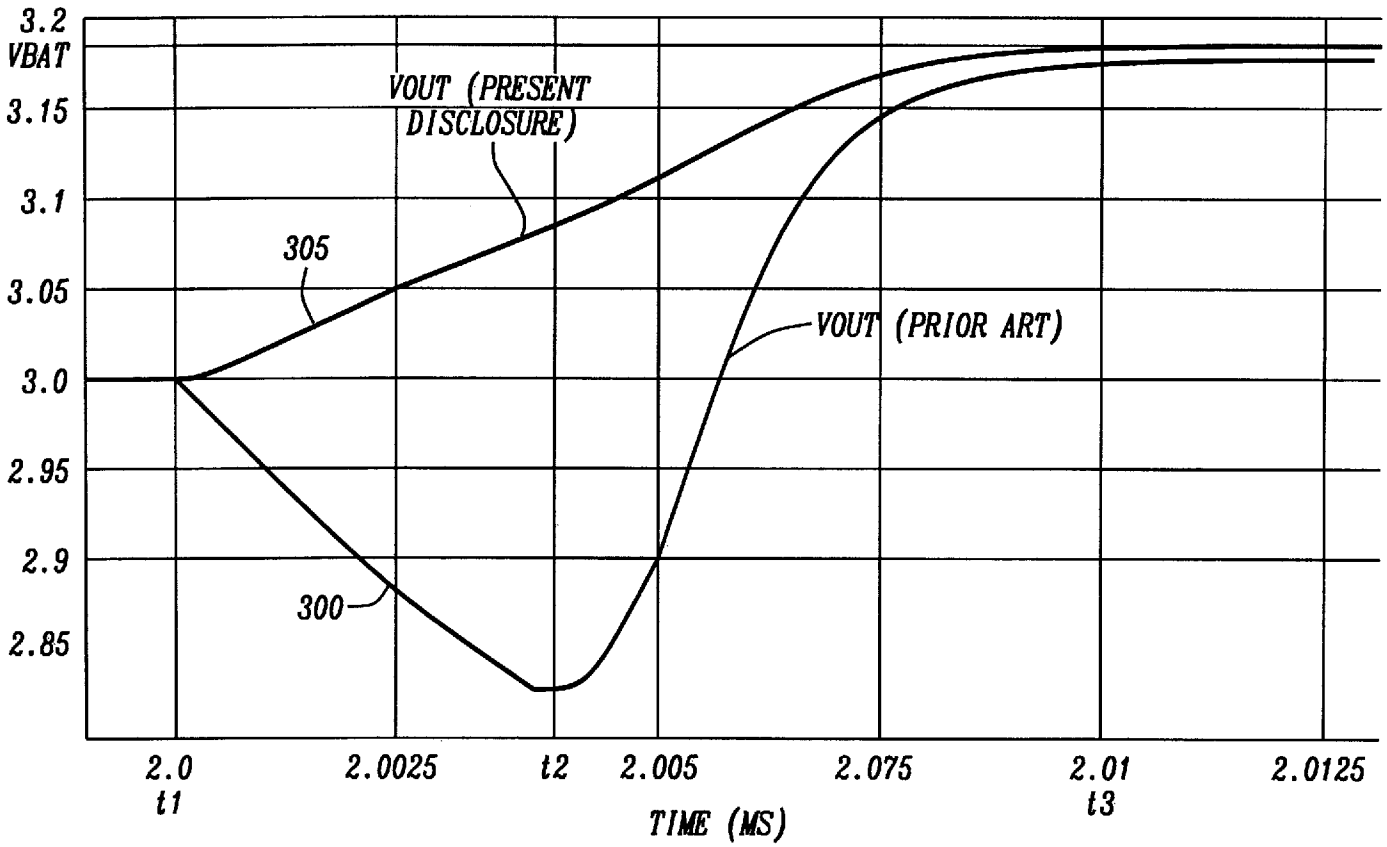
FIGS. 8 and 9 are plots comparing the operation of a dual mode low dropout voltage regulator of the prior art and a dual mode low dropout voltage regulator of the embodiments exemplifying the principals of the present disclosure.
Figure 9:
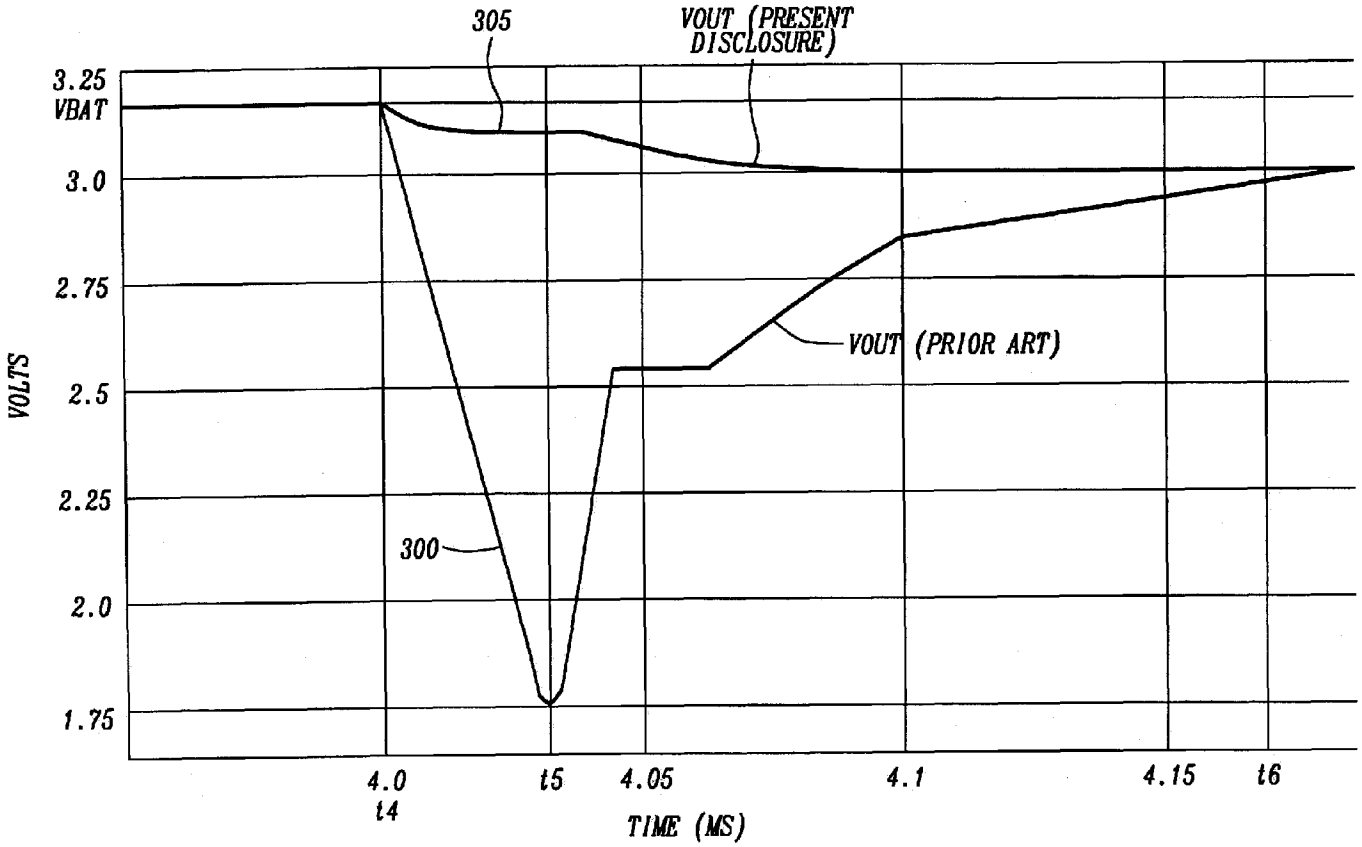

FIGS. 8 and 9 are plots comparing the operation of a dual mode low dropout voltage regulator of the prior art and a dual mode low dropout voltage regulator of the embodiments exemplifying the principals of the present disclosure. Referring to FIG. 8, the bypass signal is activated at the time t1. The output voltage level VOUT of the dual mode low dropout voltage regulator of the prior art 300 begins to decrease. The low dropout control circuit is disabled and the bypass control circuit is charging its internal node in preparation for driving the PMOS pass transistor to turn it on, at the t2, to set the output voltage level VOUT of the prior art to the voltage level of the Unregulated battery voltage source VBAT at the time t3.

The output voltage level VOUT of the dual mode low dropout voltage regulator of the present disclosure 305 begins to increase to the voltage level of the unregulated battery voltage source VBAT at the time t3. In the embodiment of FIG. 4, the low dropout control circuit is not disabled and in fact the low dropout gate control voltage 25 drives the PMOS pass transistor $P_{PASS}$ to turn on the PMOS pass transistor $P_{PASS}$ to cause the output voltage level VOUT of the dual mode low dropout voltage regulator of the present disclosure 305 to raise. When the bypass control circuit has charged its internal nodes and assumes the driving of the gate of the PMOS pass transistor $P_{PASS}$, the output voltage level VOUT of the present disclosure 305 continues to rise to the voltage level of the unregulated battery voltage source VBAT at the time t3.

In the embodiment of FIG. 6, the low dropout control circuit is not disabled and in fact the low dropout gate control voltage 25 drives the PMOS pass transistor $P_{PASS}$ to turn on the PMOS pass transistor $P_{PASS}$ to cause the output voltage level VOUT of the dual mode low dropout voltage regulator of the present disclosure 305 to raise the voltage level of the unregulated battery voltage source VBAT at the time t3.

Referring to FIG. 9, the bypass signal is deactivated at the time t4. The output voltage level VOUT of the dual mode low dropout voltage regulator of the prior art 300 begins to decrease. The bypass control circuit is disabled and the low dropout control circuit is charging its internal node in preparation for driving the PMOS pass transistor $P_{PASS}$ to turn it on, at the t5, to set the output voltage level VOUT of the prior art to the regulated voltage level at the time t6.

The output voltage level VOUT of the dual mode low dropout voltage regulator of the present disclosure 305 begins to decrease to the voltage level from that of the unregulated battery voltage source VBAT at the time t4. In the embodiment of FIG. 4, the low dropout control circuit is enabled with the low dropout gate control voltage 25 driving the PMOS pass transistor $P_{PASS}$ to turn on the PMOS pass transistor $P_{PASS}$ support the output voltage level VOUT of the dual mode low dropout voltage regulator of the present disclosure 305. When the switched error voltage clamp 103 is disabled, the error amplifier 101 begins to control the output voltage level VOUT of the dual mode low dropout voltage regulator of the present disclosure 305. The feedback voltage level $V_{FB}$ indicates that the output voltage level VOUT of the present disclosure 305 is at the regulated voltage level at the time t6.

In the embodiment of FIG. 6, the switched error voltage clamp 103 is disabled at the time t4 and the error amplifier 101 begins to control the output voltage level VOUT of the dual mode low dropout voltage regulator of the present disclosure 305. The output voltage level VOUT of the dual mode low dropout voltage regulator of the present disclosure 305 continues to fall until the feedback voltage level $V_{FB}$ indicates that the output voltage level VOUT of the present disclosure 305 is at the regulated voltage level at the time t6.

Figure 10:
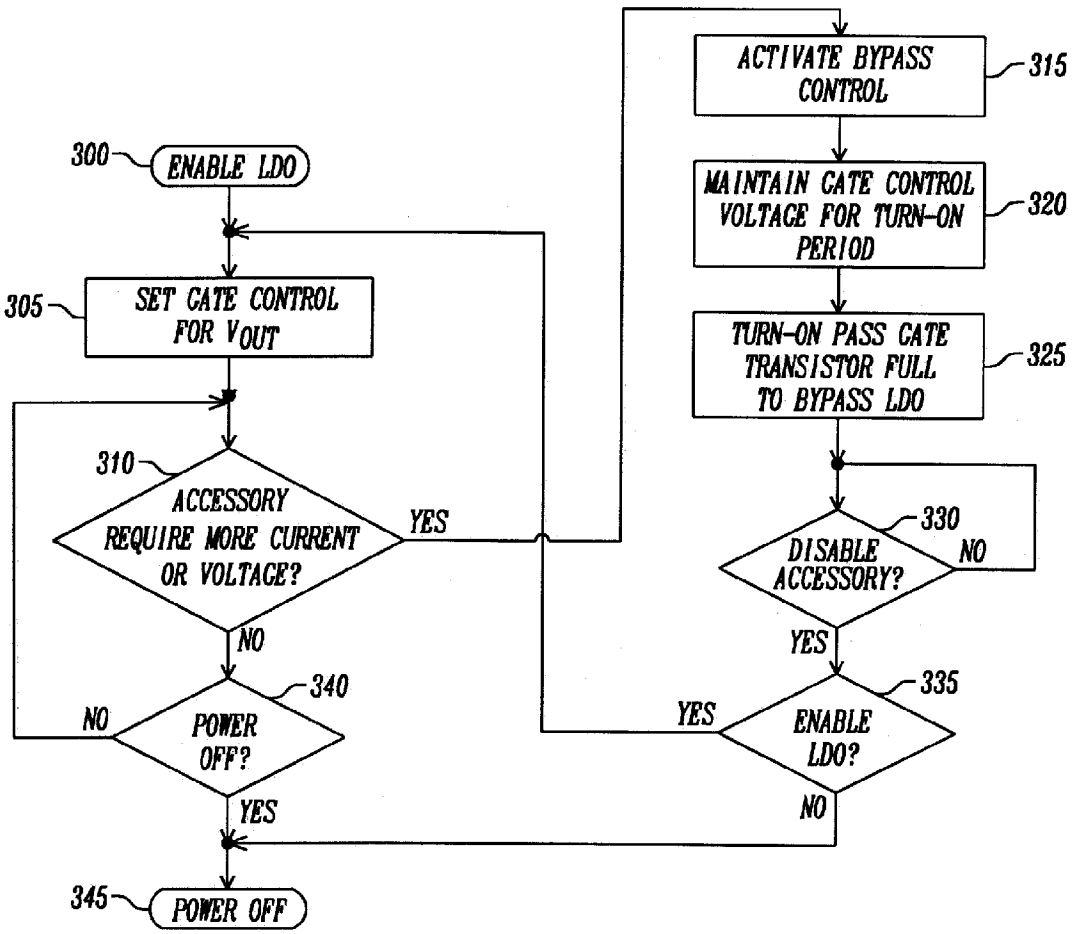
FIG. 10 is a flowchart of a method of operation performed by a dual mode low dropout voltage regulator embodying the principles of this disclosure.

FIG. 10 is a flowchart of a method of operation performed by a dual mode low dropout voltage regulator embodying the principles of this disclosure that has a low dropout regulation mode and a bypass mode. The dual mode low voltage dropout voltage regulator provides a smooth transition between mode transitions taking place under load. The dual mode low dropout voltage regulator embodying the principles of this disclosure is enabled (Box 300) by the application of an external enabling signal. The low dropout voltage regulator with a bypass mode, an error amplifier compares a feedback voltage that is a proportional value of the output voltage level of the dual mode low dropout voltage regulator. The output of the error amplifier is conditioned to drive the gate of a pass transistor of the dual mode low dropout voltage regulator. The voltage of the output of the error amplifier is adjusted (Box 305) until the voltage level at the output of the dual mode low dropout voltage regulator is at its regulated voltage level.

A system controller monitors (Box 310) the connectors into which any accessories are connected to the system. When the system controller receives a request from an accessory attached to the system for a current or voltage level that is larger than the regulated voltage level of the dual mode low dropout voltage regulator, the system controller activates (Box 315) the bypass signal commanding the dual mode low dropout voltage regulator to go into bypass mode and transfer the voltage level of the unregulated input voltage source to the output of the dual mode low dropout voltage regulator. The dual mode low dropout voltage regulator is functioning is its normal operating mode to continue to maintain (Box 320) a smooth transition to the bypass to prevent the output of the dual mode low dropout voltage regulator from decreasing or having a "brown out". The pass transistor is then forced (Box 325) to turn on fully to provide the voltage level of the unregulated input voltage source to fully bypass the low dropout regulating mode of operation.

The system controller monitors (Box 330) the accessory to determine if it able to be disabled. The dual mode low dropout voltage regulator remains in the bypass mode until the accessory is disabled. When the bypass mode is disabled, it is determined (Box 335) if the dual mode low dropout voltage regulator is enabled. If the dual mode low dropout voltage regulator is enabled, the low dropout regulation mode may be re-established (Box 305). In addition to monitoring (Box 310) if an accessory is requesting additional voltage, the system controller is monitoring (Box 340) if the system or the accessory is having its power turned off. If the accessory remains operating, the system controller is monitoring (Box 310) if the accessory requires more current or voltage and is monitoring (Box 340) if the power is removed. When the system receives a request for the power to be turned off, the dual mode low dropout voltage regulator is disabled (Box 345) and the power is removed.

While this disclosure has been particularly shown and described with reference to the preferred embodiments thereof, it will be understood by those skilled in the art that various changes in form and details may be made without departing from the spirit and scope of the disclosure. In particular, the transistors of the dual mode low dropout regulator of FIGS. 4 and 6 are shown as PMOS and NMOS field effect transistors. The conductivity types of the PMOS transistors and the NMOS transistors may be exchanged such that those shown in FIGS. 4 and 6 as PMOS transistors may be NMOS and the NMOS transistors may be PMOS transistors with attendant changing of the voltage levels. Further, the transistors of the low dropout voltage regulator may be P-type and N-type bipolar transistors and be in keeping with the scope of this disclosure.

What is claimed is:

1. A dual mode low dropout voltage regulator comprising:

a low dropout regulation control circuit for controlling regulation of a voltage level at an output terminal of the dual mode low dropout regulator when the dual mode low dropout voltage regulator is in a low dropout regulation mode;

a bypass control circuit for forcing the voltage level at the output terminal of the dual mode voltage regulator to be approximately a voltage level of an unregulated input voltage level applied to an input terminal of the dual mode low dropout voltage regulator in a bypass mode;

an analog multiplexer connected to the low dropout regulation control circuit and the bypass control circuit for selecting the low dropout regulation control circuit in the low dropout regulation mode and the bypass control circuit in the bypass mode; and a mode transition circuit in communication with the low dropout regulation control circuit and the bypass control circuit for smoothing a transition between the low dropout regulation mode and the bypass mode of the dual mode low dropout voltage regulator while under load, wherein the mode transition circuit receives a bypass signal, the mode transition circuit clamps an output of an error amplifier within the low dropout regulation circuit to prevent the output voltage level from decreasing and then as the bypass control circuit becomes active, forcing the output voltage level to begin to increase to approximately the voltage level of the unregulated input voltage level, wherein the mode transition circuit comprises:

a bypass delay circuit connected for receiving a bypass signal that indicates that the dual mode low dropout voltage regulator is transitioning to a bypass mode and delay the bypass signal by an amount of time equal to an amount of time in which the bypass control circuit's internal nodes charge to become active and connected to the analog multiplexer for selecting the bypass control circuit when the bypass mode is activated and the bypass control circuit is active;

a switched error voltage clamp connected to receive the bypass signal to clamp the output of an error amplifier within the low dropout regulation circuit for preventing the output voltage level from decreasing; and a bypass switch circuit connected to the bypass delay circuit for receiving the delayed bypass signal to force the output of the low dropout regulation circuit to a voltage level of the power supply voltage source.

2. The dual mode low dropout voltage regulator of claim 1 wherein the switched error clamp comprises:

a clamp diode that has an cathode connected to the ground reference voltage source and an anode;

a clamp switch having a first terminal connected to the output of the error amplifier, a second terminal connected to anode of the clamp diode, and a control terminal to receive the bypass signal such that the switching device is activated when the bypass signal is activated to clamp the error voltage level at the output of the error amplifier to approximately the operating voltage level of the error amplifier to prevent the output voltage level of the dual mode low dropout voltage regulator from decreasing;

wherein when the bypass signal is deactivated, the clamp switch is opened and the error amplifier begins to regulate the voltage level of the output voltage level of the dual mode low dropout voltage regulator.

3. The dual mode low dropout voltage regulator of claim 2 wherein the clamp diode is a diode connected transistor.

4. A dual mode low dropout voltage regulator comprising:

a low dropout regulation control circuit for controlling regulation of a voltage level at an output terminal of the dual mode low dropout regulator to a load when a bypass signal indicates that the dual mode low dropout voltage regulator is in a low dropout regulation mode, for forcing the voltage level at the output terminal of the dual mode voltage regulator applied to the load to be approximately a voltage level of an unregulated input voltage level applied to an input terminal of the dual mode low dropout voltage regulator in a bypass mode, and for smoothing a transition between the low dropout regulation mode and the bypass mode of the dual mode low dropout voltage regulator the load is connected to the output terminal, wherein when the bypass signal is activated, an output voltage level of an error amplifier within the low dropout regulation circuit is clamped to approximately its operating voltage level for preventing the output voltage level at the output terminal from decreasing and then forcing the output voltage level to increase to approximately the voltage level of the unregulated input voltage level, wherein the low dropout regulation circuit comprises:

a switched error voltage clamp for connected for receiving the bypass signal to clamp the output voltage level of the error amplifier to approximately its operating voltage level for preventing the output voltage level from decreasing; and a bypass switch circuit to a pass gate driver circuit within the low dropout regulation circuit for receiving the bypass signal to force the a gate of a pass transistor of the dual mode low dropout voltage regulator to a voltage level of a ground reference voltage level for turning on the pass transistor to force the output voltage level of the dual mode low dropout voltage regulator to the voltage level of the unregulated input voltage level.

5. The dual mode low dropout voltage regulator of claim 4 wherein the bypass switch circuit comprises:

a switch device having a first terminal connected to a load device of the pass gate driver circuit, a second terminal connected to a pass gate switch transistor of the pass gate driver circuit, a control terminal connected to receive the bypass signal;

a current limiter connected in parallel with the switch device such that a first terminal of the current limiter is connected to the first terminal of the switch device and a second terminal of the current limiter is connected to the seconder terminal of the switch device; and a switch transistor having a drain connected to the second terminals of the switch device and the current limiter and connected to a gate of the pass transistor, a source connected to the ground reference voltage source, and a gate connected to receive the bypass signal such that when the bypass signal is activated the switch transistor is turned on and the gate of the pass gate switch transistor is turned on and the gate of the pass transistor is connected to the ground reference voltage source to turn on the pass transistor to force the voltage level at the output of the dual mode low dropout voltage regulator to be approximately the voltage level of the unregulated input voltage level.

6. The dual mode low dropout voltage regulator of claim 4 wherein the switched error clamp comprises:

a clamp diode that has an cathode connected to the ground reference voltage source and an anode;

a clamp switch having a first terminal connected to the output of the error amplifier, a second terminal connected to the anode of the clamp diode, and a control terminal to receive the bypass signal such that the switching device is activated when the bypass signal is activated to clamp the error voltage level at the output of the error amplifier to approximately the operating voltage level of the error amplifier to prevent the output voltage level of the dual mode low dropout voltage regulator from decreasing;

wherein when the bypass signal is deactivated, the clamp switch is opened and the error amplifier begins to regulate the voltage level of the output voltage level of the dual mode low dropout voltage regulator.

7. The dual mode low dropout voltage regulator of claim 6 wherein the clamp diode is a diode connected transistor.

8. A method of operation for a dual mode low dropout voltage regulator to provide a smooth transition between a low dropout regulation mode and a bypass mode taking place under load, comprising the steps of:

enabling the dual mode low dropout voltage regulator by the application of an external enabling signal;

adjusting a voltage level of an output of an error amplifier within the dual mode low dropout voltage regulator until the voltage level at the output of the dual mode low dropout voltage regulator is at its regulated voltage level;

monitoring by a system controller connectors into which any accessories are connected to a system into which the dual mode low dropout voltage regulator is integrated;

receiving by the system controller a request from one accessory attached to the system for a current or voltage level that is larger than the regulated voltage level of the dual mode low dropout voltage regulator;

activating by the system controller a bypass signal commanding the dual mode low dropout voltage regulator to enter the bypass mode and transfer a voltage level of the unregulated input voltage source to the output terminal of the dual mode low dropout voltage regulator;

continuing to maintain approximately the operating level of the dual mode a smooth transition to the bypass mode to prevent the output of the dual mode low dropout voltage regulator from decreasing or having a "brown out"; and forcing a pass transistor of the dual mode low dropout voltage regulator to provide the voltage level of the unregulated input voltage source to fully bypass the low dropout regulating mode of operation.

9. The method of operation for a dual mode low dropout voltage regulator of claim 8 further comprising the steps of:

monitoring by the system controller the accessory to determine if it able to be disabled deactivating by the system controller the bypass signal, when the accessory is disabled;

determining if the dual mode low dropout voltage regulator is enabled; and re-establishing the low dropout regulation mode, when the dual mode low dropout voltage regulator is enabled.

10. An electronic device comprising:

a dual mode low dropout voltage regulator comprising:

a low dropout regulation control circuit for controlling regulation of a voltage level at an output terminal of the dual mode low dropout regulator when the dual mode low dropout voltage regulator is in a low dropout regulation mode;

a bypass control circuit for forcing the voltage level at the output terminal of the dual mode voltage regulator to be approximately a voltage level of an unregulated input voltage level applied to an input terminal of the dual mode low dropout voltage regulator in a bypass mode;

an analog multiplexer connected to the low dropout regulation control circuit and the bypass control circuit for selecting the low dropout regulation control circuit in the low dropout regulation mode and the bypass control circuit in the bypass mode; and a mode transition circuit in communication with the low dropout regulation control circuit and the bypass control circuit for smoothing a transition between the low dropout regulation mode and the bypass mode of the dual mode low dropout voltage regulator while under load, wherein the mode transition circuit receives a bypass signal, the mode transition circuit clamps an output of an error amplifier within the low dropout regulation circuit to for preventing the output voltage level from decreasing and then as the bypass control circuit becomes active, forcing the output voltage level to begin to increase to approximately the voltage level of the unregulated input voltage level, wherein the mode transition circuit comprises:

a bypass delay circuit connected for receiving a bypass signal that indicates that the dual mode low dropout voltage regulator is transitioning to a bypass mode and delay the bypass signal by an amount of time equal to an amount of time in which the bypass control circuit's internal nodes charge to become active and connected to the analog multiplexer for selecting the bypass control circuit when the bypass mode is activated and the bypass control circuit is active;

a switched error voltage clamp connected for receiving the bypass signal to clamp the output of an error amplifier within the low dropout regulation circuit for preventing the output voltage level from decreasing; and a bypass switch circuit connected to the bypass delay circuit for receiving the delayed bypass signal to force the output of the low dropout regulation circuit to a voltage level of the power supply voltage source.

11. The electronic device of claim 10 wherein the switched error clamp comprises:

a clamp diode that has an cathode connected to the ground reference voltage source and an anode;

a clamp switch having a first terminal connected to the output of the error amplifier, a second terminal connected to the anode of the clamp diode, and a control terminal to receive the bypass signal such that the switching device is activated when the bypass signal is activated to clamp the error voltage level at the output of the error amplifier to approximately the operating voltage level of the error amplifier to prevent the output voltage level of the dual mode low dropout voltage regulator from decreasing;

wherein when the bypass signal is deactivated, the clamp switch is opened and the error amplifier begins to regulate the voltage level of the output voltage level of the dual mode low dropout voltage regulator.

12. The electronic device of claim 11 wherein the clamp diode is a diode connected transistor.

13. An electronic device comprising:

a dual mode low dropout voltage regulator comprising:

a low dropout regulation control circuit for controlling regulation of a voltage level at an output terminal of the dual mode low dropout regulator to a load when a bypass signal indicates that the dual mode low dropout voltage regulator is in a low dropout regulation mode, for forcing the voltage level at the output terminal of the dual mode voltage regulator applied to the load to be approximately a voltage level of an unregulated input voltage level applied to an input terminal of the dual mode low dropout voltage regulator in a bypass mode, and for smoothing a transition between the low dropout regulation mode and the bypass mode of the dual mode low dropout voltage regulator the load is connected to the output terminal, wherein when the bypass signal is activated, an output voltage level of an error amplifier within the low dropout regulation circuit is clamped to approximately its operating voltage level to prevent the output voltage level at the output terminal from decreasing and then forcing the output voltage level to increase to approximately the voltage level of the unregulated input voltage level, wherein the low dropout regulation circuit comprises:

a switched error voltage clamp for connected to receive the bypass signal to clamp the output voltage level of the error amplifier to approximately its operating voltage level to prevent the output voltage level from decreasing; and a bypass switch circuit to a pass gate driver circuit within the low dropout regulation circuit for receiving the bypass signal to force a gate of a pass transistor of the dual mode low dropout voltage regulator to a voltage level of a ground reference voltage level for turning on the pass transistor to force the output voltage level of the dual mode low dropout voltage regulator to the voltage level of the unregulated input voltage level.

14. The electronic device of claim 13 wherein the bypass switch circuit comprises:

a switch device having a first terminal connected to a load device of the pass gate driver circuit, a second terminal connected to a pass gate switch transistor of the pass gate driver circuit, a control terminal connected to receive the bypass signal;

a current limiter connected in parallel with the switch device such that a first terminal of the current limiter is connected to the first terminal of the switch device and a second terminal of the current limiter is connected to the seconder terminal of the switch device; and a switch transistor having a drain connected to the second terminals of the switch device and the current limiter and connected to a gate of the pass transistor, a source connected to the ground reference voltage source, and a gate connected to receive the bypass signal such that a bypass delay circuit connected to receive a bypass signal that indicates that the dual mode low dropout voltage regulator is to transition to a bypass mode and delay the bypass signal by an amount of time equal to an amount of time in which the bypass control circuit's internal nodes charge to become active and connected to the analog multiplexer to select the bypass control circuit when the bypass mode is activated and the bypass control circuit is active.

15. The electronic device of claim 13 wherein the switched error clamp comprises:

a clamp diode that has an cathode connected to the ground reference voltage source and an anode;

a clamp switch having a first terminal connected to the output of the error amplifier, a second terminal connected to the anode of the clamp diode, and a control terminal to receive the bypass signal such that the switching device is activated when the bypass signal is activated to clamp the error voltage level at the output of the error amplifier to approximately the operating voltage level of the error amplifier to prevent the output voltage level of the dual mode low dropout voltage regulator from decreasing;

wherein when the bypass signal is deactivated, the clamp switch is opened and the error amplifier begins to regulate the voltage level of the output voltage level of the dual mode low dropout voltage regulator.

16. The electronic device of claim 15 wherein the clamp diode is a diode connected transistor.

* * * * *